United States Patent [19]

Buxbaum

[11] 4,274,029

[45] Jun. 16, 1981

[54] GAS DISCHARGE DEVICE WITH METAL OXIDE CARRIER IN DISCHARGE PATH

[75] Inventor: Charley Buxbaum, Baden, Switzerland

[73] Assignee: BBC Brown, Boveri & Company, Limited, Baden, Switzerland

[21] Appl. No.: 27,734

[22] Filed: Apr. 6, 1979

[30] Foreign Application Priority Data

Apr. 28, 1978 [CH] Switzerland ..... 4628/78

[51] Int. Cl.[3] ..... H01J 61/10; H01J 61/26; H01J 61/30

[52] U.S. Cl. ..... 313/204; 313/212; 313/221

[58] Field of Search ..... 313/221, 213, 181, 204, 313/212; 316/9

[56] References Cited

U.S. PATENT DOCUMENTS

| | | | |
|---|---|---|---|
| 2,008,066 | 7/1935 | Ende | 313/221 X |
| 2,530,990 | 11/1950 | Peters | 313/212 X |
| 2,637,830 | 5/1953 | Sharkey | 313/221 X |
| 2,885,587 | 4/1959 | Wainio et al. | 313/212 X |
| 3,376,457 | 4/1968 | Hoeh | 313/204 X |
| 3,683,226 | 8/1972 | Witting | 313/212 X |
| 4,117,374 | 9/1978 | Witting | 313/212 X |

*Primary Examiner*—Palmer C. Demeo

*Attorney, Agent, or Firm*—Oblon, Fisher, Spivak, McClelland & Maier

[57] ABSTRACT

A gas discharge vessel and a process for extending the life of a gas discharge vessel, which is used as a radiation source, is permeable to radiation of a wavelength from 10 to 1,000 nm and has an activated cathode, wherein a metal oxide, of which the free enthalpy $\Delta G$, under the pressure and temperature conditions prevailing in the vessel, is both greater than the free enthalpy of the oxides, from which the vessel is constructed, and greater than the free enthalpy of any oxide or suboxide of the element constituting the activating substance applied to the cathode is introduced in the discharge path.

14 Claims, 8 Drawing Figures

GAS DISCHARGE DEVICE WITH METAL OXIDE CARRIER IN DISCHARGE PATH

BACKGROUND OF THE INVENTION

The invention relates to a process for extending the life of a gas discharge vessel which is used as a radiation source, is permeable to radiation of a wavelength from 10 to 1,000 nm and has an activated cathode.

The invention also relates to a gas discharge vessel according to the process mentioned above.

Gas discharge vessels used as a radiation source, such as mercury vapor lamps, sodium vapor lamps or metal vapor lamps of other types, fluorescent tubes and the like, are as a rule equipped with so-called activated cathodes in order to improve their starting properties and their operating behavior. The activating substance applied to the cathode surface serves to reduce the work function of the metal compounds—preferably oxides—of the elements of the first three Groups of the Periodic Table (alkalis, alkaline earths and earths) are used in most cases. Above all, barium and its compounds are known from the literature for this purpose (for example Swiss Pat. No. 570,040).

The life of gas discharge vessels is largely determined by the processes taking place on the cathode surface. In the course of operation, both the activating substance and the cathode material vaporize or are atomized. The substances present, in most cases, in the elementary form, then precipitate on the inner walls of the discharge vessel and, in the course of time, reduce its permeability to the radiation to be emitted. For the usefulness of a vessel, however, its transparency is decisive. The particles precipitated on the inner wall—in particular the portions from the activating substance, which are present in the metallic form and which are relatively basic in nature and have a high affinity for oxygen—now react with the vessel material and change its chemical/physical properties in an unfavorable manner. The discharge vessels, predominantly made of glasses rich in quartz, become brown after a relatively short time and finally black and completely opaque ("blind"). This disadvantageous behavior in operation cannot be substantially improved by conventional measures such as adjusting the vessel temperatures, the gas filling, the operation of the cathode or the like.

SUMMARY OF THE INVENTION

It is the object of the invention to provide a process and means for extending the life of gas discharge vessels, the changes which adversely affect the permeability of the vessel wall to radiation, in the course of operation, being prevented in an effective manner. It is a further object of the invention to propose suitable constructional measures which make it possible to build gas discharge vessels of long life.

According to the invention, this is achieved when a metal oxide, of which the free enthalpy $\Delta G$, under the pressure and temperature conditions prevailing in the vessel, is both greater than the free enthalpy of the oxides, from which the vessel is constructed and greater than the free enthalpy of any oxide or sub-oxide of the element constituting the activating substance applied to the cathode, is introduced into the discharge path of the gas discharge vessel.

The free enthalpy $\Delta G$, variously known as the Gibbs function or Gibbs free energy is defined as $\Delta H - T\Delta S$, wherein H is enthalpy, T is temperature and S is entropy. In other words, the free enthalpy $\Delta G$ is the negative value of the maximum work, in addition to expansion work, which can be obtained from a given process at constant temperature and pressure. (See for example Lewis and Randall, "Thermodynamics" McGraw-Hill Book Company, Inc. (1961) pp. 140–141.)

According to the invention, the discharge vessel is characterized in that the metal oxide is located in the discharge space between the electrodes on the side immediately adjacent to the cathode, between the latter and the vessel wall.

According to the invention, the discharge vessel is characterized in that a metallic carrier bearing the metal oxide is located in the discharge space between the electrodes on the side immediately adjacent to the cathode between the latter and the vessel wall.

According to the invention, the discharge vessel is characterized in that the metal oxide is applied in the form of a powder or paste to the inside of the vessel wall, corresponding to the part of the discharge path on the cathode side.

According to the invention, the discharge vessel is characterized in that the metal oxide is applied by vapor deposition to the inside of the vessel wall, corresponding to the part of the discharge path on the cathode side.

DETAILED DESCRIPTION OF THE INVENTION

Figure 1:
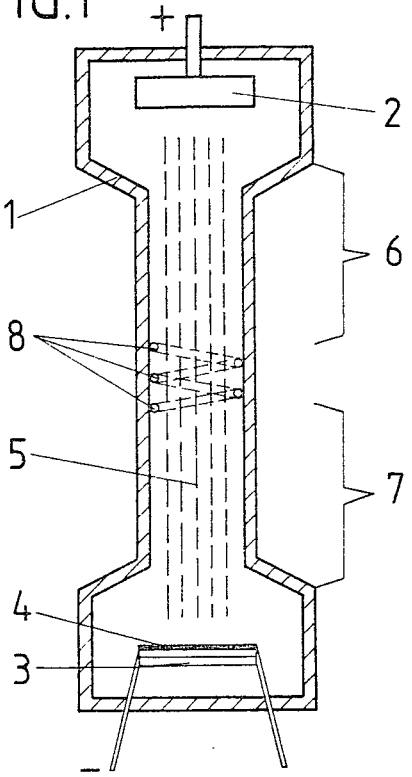
FIG. 1 shows a diagrammatic longitudinal section through a gas discharge vessel.

The essential guiding concept of the process according to the invention is that a reduction of the oxides which comprise the vessel wall is prevented by the addition of suitable metal oxides.

The invention is based on the finding that the vessel material (for example $SiO_2$) is reduced by the metal originating from the activating substance (hereinafter designated as ME) in accordance with the following equation:

$$SiO_2 + k \cdot \frac{4}{W_1} ME \longrightarrow SiO_{2(1-k)} + k \cdot \frac{4}{W_1} MEO_{\frac{W_1}{2}} \quad (1)$$

wherein $O < k \leqq 1$ and $W_1$ denotes the valency of ME.

For example, the following simplified equation would result for a divalent metal ME from the activating substance:

$$SiO_2 + k \cdot 2ME \rightarrow SiO_{2(1-k)} + k \cdot 2MEO \quad (1')$$

wherein $O < k \leqq 1$

Analogous equations can be stated for trivalent and tetravalent ME's.

Reactions can also occur, in which ME is oxidized only partially, the following equation resulting for divalent ME's:

$$SiO_2 + 2ME \rightarrow SiO_{2(1-k)} + 2\ MEO_k \quad (1'')$$

wherein $O < k \leqq 1$

In each case, the sub-oxide of silicon or the element silicon is formed, in accordance with the formula $SiO_{2(1-k)}$.

It is characteristic of the sub-oxide that its transparency decreases with the fall of its oxygen content. The point is therefore, as far as possible, to prevent this fall in the oxygen content by a reaction in the opposite direction and at the same time to stop the metal (ME), which originates from the activated substance, precipitating on the vessel wall. This is achieved by the use of certain, more readily reducible metal oxides (hereinafter designated as MO), the following reactions taking place:

Oxidation of ME to an oxide:

$$\frac{W_2}{2} ME + \frac{W_1}{2} MO_{\frac{W_2}{2}} \longrightarrow \frac{W_2}{2} MEO_{\frac{W_1}{2}e} + \frac{W_1}{2} MO_{\frac{W_2}{2}(1-e)} \quad (2)$$

wherein $O < e \leqq 1$ and $W_1$ denotes the valency of ME and $W_2$ denotes the valency of M.

For a divalent metal ME and a divalent metal M, the following equation would apply:

$$ME + MO \rightarrow MEO_e + MO_{1-e} \quad (2')$$

wherein $O < e \leqq 1$

If possible, e should become equal to 1 so that all the present vapor of the metal ME is at least transformed into a stable oxide and no reducing power whatsoever remains for the $SiO_2$.

Re-oxidation of the sub-oxide of silicon and of elementary silicon:

$$SiO_{2(1-k)} + k \cdot \frac{4}{W_2} MO_{\frac{W_2}{2}} \longrightarrow SiO_2 + k \cdot \frac{4}{W_2} M \quad (3)$$

wherein $O < k \leqq 1$ and $W_2$ denotes the valency of M.

For a divalent metal M, the following simplified formula would apply:

$$SiO_{2(1-k)} + k \cdot 2MO \rightarrow SiO_2 + k \cdot 2\ M \quad (3')$$

wherein $O < k \leqq 1$

Analogous equations can be stated for other than divalent M's.

Reactions can also occur, in which MO is not completely reduced to the metal M, the following equation resulting for divalent M's:

$$SiO_{2(1-k)} + 2MO \rightarrow SiO_2 + 2MO_{1-k} \quad (3'')$$

wherein $O < k \leqq 1$.

The vapor of the metal ME is thus oxidized to the oxide $MEO_e$ by MO, before it has precipitated on the vessel wall, and the silicon which may already have been reduced to $SiO_{2(1-k)}$ is re-oxidized to $SiO_2$ by MO. In this way, the permeability of the vessel wall to the intended radiation is ensured, as long as there is a stock of MO for covering the requirement for the reactions (2) and (3) or (3'') to proceed.

The conditions that the reactions (2) and (3) can proceed at all towards the right, are determined by the value of the free enthalpy $\Delta G$ of the oxides concerned under the conditions of use (pressure and temperature).

Thus, the following conditions must be satisfied:

$\Delta G$ of MO must be higher than $\Delta G$ of $MEO_k$, and $\Delta G$ of MO must be higher than $\Delta G$ of $SiO_2$.

The curve, which as a rule rises above the temperature scale from bottom left to the right, for $\Delta G$ of MO (relative to 1 mol of $O_2$) must therefore lie in every case, across the entire temperature range of interest, both above the curve for $\Delta G$ of $MEO_k$ and above the curve for $\Delta G$ of $SiO_2$.

Of course, the above considerations also apply to all other components which constitute the vessel wall, preferably metal oxides, in particular to glasses of all types, including boron-containing glasses, corundum ($Al_2O_3$) and the like. It is possible in every case to indicate the corresponding reduction equations and the conditions for the free enthalpy $\Delta G$. It is a prerequisite for the selection of material that the reactants, which play a decisive part, that is to say the metal oxide MO, the sub-oxide or metal $MO_{1-k}$ being formed therefrom and the re-formed sub-oxide or oxide $MEO_k$ of the activating substance, are permeable in the radiation range of interest and are inert towards the gases and vapors arising and towards the vessel wall.

The metal oxide (MO) introduced into the discharge path of the vessel is preferably an oxide of at least one of the group consisting of the elements of Group V B and VI B of the Periodic Table, Mn, Fe, Co, Ni, Cu, Zn, Cd, Hg, Ga, In, Tl, Ge, Sn, Pb, Sb, Bi and Po. More preferably, the oxides are selected from vanadium oxide, niobium oxide, tantalum oxide, chromium oxide, molybdenum oxide, tungsten oxide, manganese oxide, iron oxide, cobalt oxide, nickel oxide, indium oxide, tin oxide or a mixture of at least two of the oxides mentioned above. Most preferably, the oxides are selected from chromium oxide, molybdenum oxide, tungsten oxide, manganese oxide, iron oxide or tin oxide.

Preferably, barium, strontium, calcium, yttrium, lanthanum and thorium are used as the elements on which the activating substances are based.

Further details of the invention can be seen in the illustrative embodiments which are explained in more detail in the following text, in part reference to figures in which:

FIG. 1 diagrammatically shows a longitudinal section through a gas discharge vessel. The vessel is delimited by the wall 1 and has two electrodes in the conventional manner, namely an anode 2 and a cathode 3, which is coated with an activating substance 4 (ME oxide), and which consists of heat-resistant carrier metal (for example tungsten or molybdenum). A coiled metal carrier 8 with superficially oxidized metal (M/MO), for example, tungsten trioxide on tungsten, is located at about half the length of the discharge path 5 formed by the geometrical arrangement between the anode 2 and the cathode 3. This arrangement can be used to demonstrate the effect of the metal oxide MO. After a certain operating period has elapsed, the part 7 of the vessel wall, facing the cathode 3, begins to discolor due to a chemical change and becomes increasingly impermeable to radiation. By contrast, the part 6 of the vessel wall which faces away from the cathode 3 and, in a manner of speaking, is located "behind" the coil 8, retains its permeability to radiation.

Figure 2:
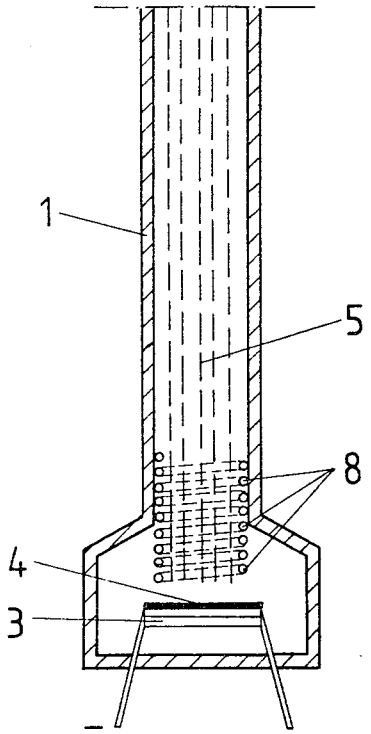
FIG. 2 shows a diagrammatic longitudinal section through the cathode part of a gas discharge vessel with an inserted coil carrying a metal oxide.

FIG. 2 shows a diagrammatic longitudinal section through the cathode part of a gas discharge vessel with a coiled metal carrier 8 which is inserted into the tubular part at the start of the discharge path 5 and which is superficially oxidized (oxide MO, for example tungsten oxide, molybdenum oxide or tantalum oxide). Since the coil is located directly opposite the cathode 3 provided with the activating substance 4, the wall 1 of the vessel is protected against chemical change over its entire length and is fully available for the emission of radiation.

Figure 3:
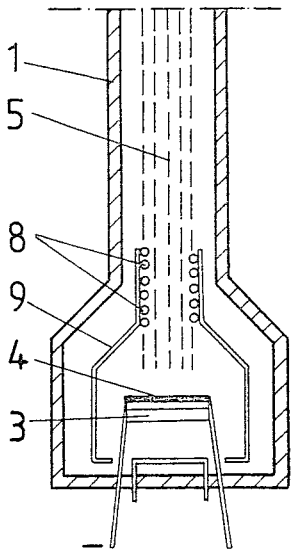
FIG. 3 shows a diagrammatic longitudinal section through a gas discharge vessel with a cathode envelope and an inserted coil.

FIG. 3, shows a different form of a coil 8 built into a gas discharge vessel. In this case, the coil is fixed to the inside of the cylindrical part of the cathode envelope 9 which is insulated from the cathode 3. The coil 8 is here also completely penetrated by the metal vapors (for example barium, yttrium or lanthanum) originating from the activating substance 4 during their passage along the discharge path so that the above-mentioned reactions can take place to the full extent and quantitively. The other reference signs correspond to FIG. 1.

Figure 4:
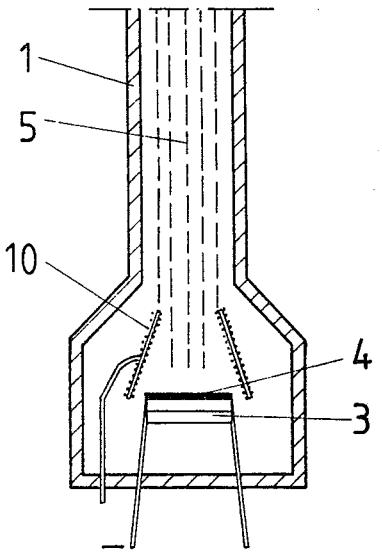
FIG. 4 shows a diagrammatic longitudinal section through a gas discharge vessel with a conical body carrying a metal oxide.

FIG. 4, shows a discharge vessel, the cathode 3 and the discharge path 5 of which are surrounded at the beginning by a conical metal carrier 10 which bears the metal oxide MO. The metal carrier 10 is fixed with insulation in the vessel wall 1 and has no metallic connection whatsoever to the cathode. It is at a "floating potential". Alternatively, the metal carrier 10 may be electrically connected to the cathode and be maintained at cathode potential. The metal vapors originating from the cathode are, in a manner of speaking, "focused" and are forced to react with the oxide MO. Of course, the form of the metal carrier 10 can also differ from that of a cone, and it can have the shape of, for example, a "dome", a "chimney stack", hyperboloid and the like. The form is almost immaterial for the effectiveness of the process and the operability of the vessel. One important point is that sufficient oxide MO is present to realize the cathode activating substance and the walls of the vessel and that its surface is in a certain ratio of the surface of the whole heated cathode 3. This ratio may vary from about 0.2 to about 2 depending on the oxide and the expected life of the vessl. For example, in the case of BaO as the activating substance 4 and $WO_3$ as the oxide MO on the carrier 10, ratio would be 0.5–0.7 for a desired life extending factor of 7 and approximately 0.3 for a life extending factor of 3.

Figure 5:
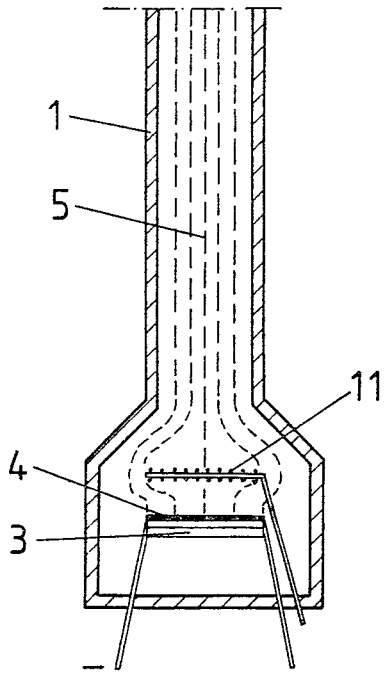
FIG. 5 shows a diagrammatic longitudinal section through a gas discharge vessel with a disc-shaped body carrying a metal oxide.

FIG. 5, shows a gas discharge vessel with a disc-shaped body 11 which carries the metal oxide MO and which is likewise fixed in such a way that it is insulated from the cathode 3. The major part of the metal particles originating from the activating substance 4 is captured by the disk-shaped construction and the arrangement of the metal carrier 11 and is prevented from precipitating on the vessel wall 1. Moreover, the metal particles are forced to make a detour so that sufficient time and space are available for the above-mentioned reactions going to completion. It is self-evident that the disc-shaped body 11 can also be of a different construction. The disc can have holes or slots or it can be replaced by a net or grid. Its contour is by no means tied to a plane shape.

Figure 6:
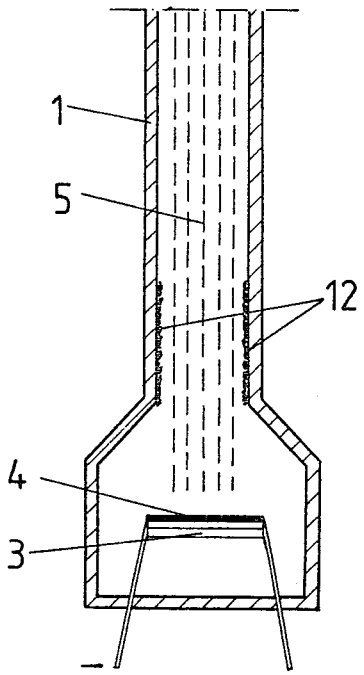
FIG. 6 shows a diagrammatic longitudinal section through a gas discharge vessel with a paste, which is applied to the vessel wall, containing a metal oxide.

FIG. 6, shows a gas discharge vessel with a paste 12 which is applied to the vessel wall 1 and contains the metal oxide MO. In this case, the procedure can, for example, be as follows: The metal oxide MO, for example $WO_3$, $MoO_2$ or $Cr_2O_3$, present in powder form is suspended in an organic solvent, for example amyl acetate, and stirred to give a paste 12. The latter is applied in a thin layer to the inside the part of the vessel wall 1 which is opposite the cathode 3, and is dried. Care must be taken that the paste 12 firmly adheres to the vessel wall 1. A vessel wall 1 finished in this way has the same effect as the measures taken in the above-mentioned examples and it is distinguished in that no constructional changes whatsocver have to be made on the discharge vessel.

Figure 7:
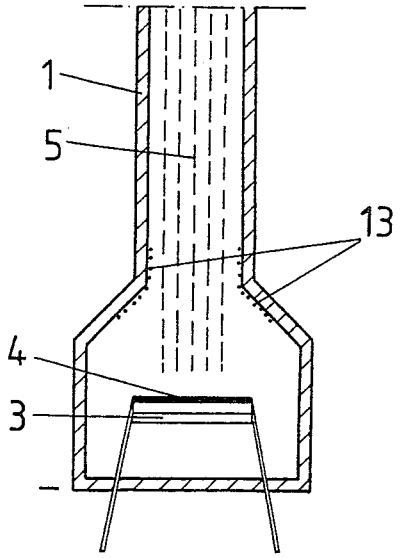
FIG. 7 shows a diagrammatic longitudinal section through a gas discharge vessel with a metal oxide which is vapor-deposited on the vessel wall.

FIG. 7, shows a gas discharge vessel with a metal oxide 13 (MO) vapor-deposited on the vessel wall 1. The effect of this metal oxide is the same as that of the paste 12 in FIG. 6. Otherwise, the reference signs correspond to FIG. 1.

Figure 8:
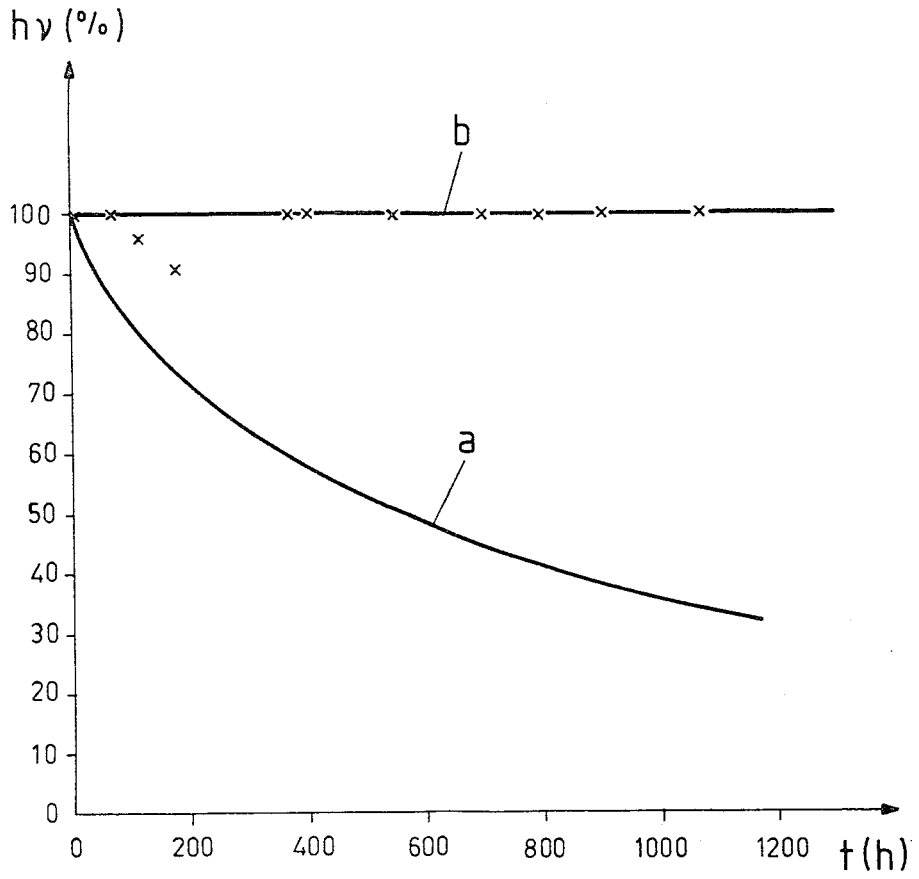
FIG. 8 shows a graphical representation of the life of mercury vapor lamps with and without a metal oxide.

In FIG. 8, the radiation yield $h\nu$, as a percentage of the initial yield, is diagrammatically shown as a function of time. The curve "a" shows the course of the radiation intensity of a conventional discharge vessel. After an operating period of less than 600 hours, the yield amounts to no more than about 50% and exponentially decreases further in the course of time. By contrast, the curve "b" represents a vessel which has been improved by the abovementioned process. Within a certain range of current, the yield remains at the level of the original value even after operating times of more than 1000 hours. The life of the vessel is thus no longer limited by "blinding" of the vessel wall.

Of course, any combination of the arrangements shown in the preceding figures are likewise possible.

Illustrative Example 1

See FIG. 1

A vanadium wire of 0.5 mm diameter and 4 m length was wound up to a coil of 12 mm mean winding diameter and then heated in air at a temperature of 700° C. for 10 minutes. The surface was thus oxidized to vanadium oxide. The coiled metal carrier 8 coated with vandium oxide was inserted into a mercury vapor high-current low-pressure lamp in such a way that is was positioned approximately halfway along the vessel wall 1 covered by the discharge path 5. The gas discharge vessel made from quartz had a heated nickel cathode 3 coated with barium oxide as the activating substance 4. In operation, the following reactions take place inter alia in the vessel:

$$3Ba + V_2O_3 \rightarrow 3BaO + 2V \quad (2)$$

$$SiO + V_2O_3 \rightarrow SiO_2 + 2VO \quad (3)$$

$$3SiO + V_2O_3 \rightarrow 3SiO_2 + 2V \quad (3')$$

The free enthalpy $\Delta G$, relative to one mol of $O_2$, of the main reactants is as follows:

| Temperature | $SiO_2$ | BaO | $V_2O_3$ |
|---|---|---|---|
| 500 K: | −781 | −1016 | −748 kJ/mol |
| 1500 K: | −593 | −836 | −573 kJ/mol |

Since the value of the free enthalpy ΔG of $V_2O_3$ (generally MO) in the temperature range of interest from 500 K. to 1500 K. throughout lies above both the value of $SiO_2$ and that for BaO (generally $MEO_k$), all the reactions (2), (3), and (3') proceed towards the right. The effect of the vanadium sesquioxide could already be detected after less than 200 operating hours by the fact that the part 6 of the vessel wall 1, lying in front of the anode 2, remained permeable for UV C ratiation without change, whilst the part 7 opposite the cathode 3 obtains a brownish discoloration as the result of the reduction of silicon dioxide to the sub-oxide.

Illustrative Example 2

See FIG. 2

A niobium wire of 0.5 mm diameter and 4 m length was wound up to a coil of 12 mm diameter and then oxidized by the process indicated under Example 1. Subsequently, the coil 8 coated with niobium oxide was built into a mercury vapor lamp immediately opposite the cathode 3. The latter consisted of nickel and had a barium salt as the activating substance 4. The reactions which are established in the course of operation are defined essentially by the following equation:

$$Ba + NbO \rightarrow BaO + Nb \quad (2)$$

$$SiO + NbO \rightarrow SiO_2 + Nb \quad (3)$$

The free enthalpy ΔG, relative to one mol of $O_2$, of the main reactants is:

| Temperature | $SiO_2$ | BaO | NbO |
|---|---|---|---|
| 500 K: | −781 | −1016 | −709 kJ/mol |
| 1500 K: | −593 | −836 | −553 kJ/mol |

Even after 500 hours burning time, the vessel wall 1 showed no discoloration whatsoever.

Illustrative Example 3

See FIG. 2

A tungsten wire of 0.5 mm diameter and 4 m length was wound up to a coil of 12 mm diameter and then superficially oxidized in a stream of oxygen to tungsten oxide at a temperature of 1000° C. for 10 minutes. The coil 8 coated in this manner was then built into a gas discharge vessel fitted with a nickel cathode 3. The cathode 3 had barium oxide as the activating substance 4. The reactions which inter alia are established in the operation are the following:

$$2Ba + WO_3 \rightarrow 3BaO + W \quad (2)$$

$$SiO + WO_3 \rightarrow SiO_2 + WO_2 \quad (3)$$

$$3SiO + WO_3 \rightarrow 3SiO_2 + W \quad (3')$$

The resulting free enthalpy ΔG, relative to one mol of $O_2$, of the main reactants is as follows:

| Temperature | $SiO_2$ | BaO | $WO_3$ |
|---|---|---|---|
| 500 K: | −781 | −1016 | −482 kJ/mol |

-continued

| Temperature | $SiO_2$ | BaO | $WO_3$ |
|---|---|---|---|
| 1500 K: | −593 | −836 | −327 kJ/mol |

The yield was still unchanged after 2000 hours.

Illustrative Example 4

See FIG. 3

A tantalum wire of 0.5 mm diameter and 4 mm length was wound up to a coil of 12 mm winding diameter and then heated in air at a temperature of 600° C. for 10 minutes. The surface was thus oxidized to tantalum oxide. The coiled metal carrier 8 coated with $Ta_2O_5$ was inserted into the cathode envelope 9 of a mercury vapor lamp. The gas discharge vessel possessed a cathode which consisted of nickel and was activated with barium oxide. The reactions taking place are inter alia the following:

$$5Ba + Ta_2O_5 \rightarrow 5BaO + 2Ta \quad (2)$$

$$2SiO + Ta_2O_5 \rightarrow 2SiO_2 + Ta_2O_3 \quad (3)$$

$$5SiO + Ta_2O_5 \rightarrow 5SiO_2 + 2Ta \quad (3')$$

The free enthalpy ΔG, relative to one mol of $O_2$, of the main reactants is:

| Temperature | $SiO_2$ | BaO | $Ta_2O_5$ |
|---|---|---|---|
| 500 K: | −781 | −1016 | −737 kJ/mol |
| 1500 K: | −593 | −836 | −565 kJ/mol |

Also in this arrangement, it was not possible to detect a decrease of the radiation yield after 800 operating hours.

Illustrative Example 5

See FIG. 4

A sheet of stainless steel of 0.2 mm thickness was chromium-plated by a conventional process. The chromium layer had a thickness of 100μ. The sheet was then formed into a body having a boundary surface in the shape of a truncated cone and was subsequently heated in a stream of oxygen at a temperature of 600° C. for 10 minutes. The surface was thus oxidized to chromium oxide. The conical metal carrier 10 coated with $Cr_2O_3$ was built into the gas discharge vessel with insulation immediately above the cathode 3. The vessel was equipped with a thoriated tungsten cathode. Inter alia, the following reactions takes place in operation:

$$3Th + 2Cr_2O_3 \rightarrow 3ThO_2 + 4Cr \quad (2)$$

$$3SiO + Cr_2O_3 \rightarrow 3SiO_2 + 2Cr \quad (3)$$

The free enthalpy ΔG, relative to one mol of $O_2$, of the main reactants results as follows:

| Temperature | $SiO_2$ | $ThO_2$ | $Cr_2O_3$ |
|---|---|---|---|
| 500 K: | −781 | −1307 | −657 kJ/mol |
| 1500 K: | −593 | −1090 | −483 kJ/mol |

After 600 operating hours, the yield of UV C radiation was still at the original value.

Illustrative Example 6

See FIG. 4

A molybdenum sheet of 0.2 mm thickness was formed into a truncated cone 10 (FIG. 4) and then heated in air at a temperature of 500° C. for 10 hours. The surface was thus oxidized to molybdenum oxide. The conical metal carrier 10 coated with $MoO_2$ was built into the gas discharge vessel with insulation immediately above the cathode 3. The vessel possessed a cathode 3 which consisted of molybdenum and was coated with $La_2O_3$ as the activating substance. Inter alia, the following reactions are established in operation:

$$4La+3MoO_2 \rightarrow 2La_2O_3+3Mo \quad (2)$$

$$SiO+MoO_2 \rightarrow SiO_2+MoO \quad (3)$$

$$SiO+2MoO_2 \rightarrow SiO_2+Mo_2O_3 \quad (3')$$

$$2SiO+MoO_2 \rightarrow 2SiO_2+Mo \quad (3'')$$

The free enthalpy ΔG, relative to one mol of $O_2$, of the main reactants is as follows:

| Temperature | $SiO_2$ | $La_2O_3$ | $MoO_2$ |
|---|---|---|---|
| 500 K: | −781 | −1110 | −461 kJ/mol |
| 1500 K: | −593 | −925 | −318 kJ/mol |

After 1500 hours burning time, the radiation yield was still 98.5% of the original yield.

Illustrative Example 7

See FIG. 5

A 0.5 mm thick sheet consisting of a manganese alloy with 2% of copper and 1% of nickel was cut to a circular disc of 20 mm diameter and then heated in air at a temperature of 600° C. for 10 minutes. The disc-shaped metal carrier 11 coated in this way with manganese oxide was built into a gas discharge vessel provided with a molybdenum cathode 3. The activating substance 4 used was lanthanum oxide. Inter alia, the following reactions occur in operation:

$$2La+3MnO \rightarrow La_2O_3+3Mn \quad (2)$$

$$SiO+MnO \rightarrow SiO_2+Mn \quad (3)$$

The free enthalpy ΔG, relative to one mol of $O_2$, of the main reactants results as follows:

| Temperature | $SiO_2$ | $La_2O_3$ | MnO |
|---|---|---|---|
| 500 K: | −781 | −1110 | −695 kJ/mol |
| 1500 K: | −593 | −925 | −548 kJ/mol |

After 900 hours operating time, it was possible to detect a fall of the radiation intensity of only less than 1% of the original value.

Illustrative Example 8

See FIG. 5

A disc of 20 mm diameter was cut from a 0.5 mm thick sheet of electrolytic iron and a fairly large number of holes of 2 mm diameter was punched into this disc. The disc was then heated in air at a temperature of 700° C. for 10 minutes, its surface being oxidized. The metal carrier 11 coated with iron oxide in this manner was inserted into a mercury vapor lamp, the cathode 3 of which, consisted of tungsten and was coated with thorium oxide. The main reactions occurring in operation are:

$$2Th+Fe_3O_4 \rightarrow 2ThO_2+3Fe \quad (2)$$

$$SiO+Fe_3O_4 \rightarrow SiO_2+3FeO \quad (3)$$

$$4SiO+Fe_3O_4 \rightarrow 4SiO_2+3Fe \quad (3')$$

The free enthalpy ΔG, relative to one mol of $O_2$, of the main reactants is:

| Temperature | $SiO_2$ | $ThO_2$ | $Fe_3O_4$ |
|---|---|---|---|
| 500 K: | −781 | −1307 | −477 kJ/mol |
| 1500 K: | −593 | −1090 | −335 kJ/mol |

After 1800 hours of vessel operation the radiation yield was still 98% of the original value.

Illustrative Example 9

See FIG. 5

A circular disc of 20 mm diameter was cut out of a net (wire netting) of cobalt wire of 0.5 mm diameter and 3 mm mesh width and then heated in air at a temperature of 800° C. for 10 minutes. The metal carrier 11 coated with CoO in this manner was inserted into a gas discharge vessel, the cathode 3 of which consisted of nickel and contained a barium oxide layer as the activating substance 4. The following main reactions occur in operation:

$$Ba+CoO \rightarrow BaO+Co \quad (2)$$

$$SiO+CoO \rightarrow SiO_2+Co \quad (3)$$

The free enthalpy ΔG, relative to one mol of $O_2$, of the main reactants results as follows:

| Temperature | $SiO_2$ | BaO | CoO |
|---|---|---|---|
| 500 K: | −781 | −1016 | −398 kJ/mol |
| 1500 K: | −593 | −836 | −238 kJ/mol |

After 1400 hours burning time, no fall in the radiation intensity was detectable.

Illustrative Example 10

See FIG. 5

A nickel wire of 0.5 mm diameter was wound up to a loose plane spiral having a mean spacing of 1 mm between windings and an external diameter of 12 mm. The disc-shaped spiral was then heated in air at a temperature of 800° C. for 10 minutes. The surface of the wire was thus oxidized to divalent nickel oxide. The disc-shaped metal carrier 11 coated with NiO in this manner was inserted into a high-current low-pressure metal vapor lamp which was fitted with a cathode 3 of lanthanum hexaboride ($LaB_6$). The resulting reactions which inter alia are established in operation are as follows:

$$2La+3NiO \rightarrow La_2O_3+3Ni \quad (2)$$

$$SiO+NiO \rightarrow SiO_2+Ni \quad (3)$$

The free enthalpy ΔG, relative to one mol of $O_2$, of the main reactants is:

| Temperature | $SiO_2$ | $La_2O_3$ | NiO |
|---|---|---|---|
| 500 K: | −781 | −1110 | −398 kJ/mol |
| 1500 K: | −593 | −925 | −205 kJ/mol |

After an operating period of 1600 hours, no decrease at all in the radiation yield was detectable.

Illustrative Example 11

See FIG. 6

3 g of cuprous oxide powder having a mean particle size of 5μ to 10μ were stirred in 0.5 ml of amyl acetate to give a stiff paste 12, and the latter was applied in a thin layer to the inner surface of the wall 1, opposite the cathode 3, of a mercury vapor lamp. The vessel was then dried and subjected for 10 minutes to a heat treatment at a temperature of 400° C. and under a pressure of $<10^{-4}$ mm Hg. The finished layer of $Cu_2O$ has a mean thickness of 0.2 mm. The gas discharge vessel was equipped with a thoriated tungsten cathode. The reactions taking place are inter alia the following:

$$Th+2Cu_2O \rightarrow ThO_2+4Cu \quad (2)$$

$$SiO+Cu_2O \rightarrow SiO_2+2Cu \quad (3)$$

The free enthalpy ΔG, relative to one mol of $O_2$, of the main reactants results as follows:

| Temperature | $SiO_2$ | $ThO_2$ | $Cu_2O$ |
|---|---|---|---|
| 500 K: | −781 | −1307 | −264 kJ/mol |
| 1500 K: | −593 | −1090 | −138 kJ/mol |

After 200 hours operating time, the radiation yield was still 99% of the value measured at the beginning of the experiment.

Illustrative Example 12

See FIG. 6

3 g of zinc oxide powder having a mean particle size of 3μ to 10μ were stirred in 0.5 ml of amyl acetate to give a stiff paste 12 and further treated in accordance with Example 11. A gas discharge vessel fitted with a tantalum cathode 3 was available. The activating substance 4 consisted of yttrium oxide. The main reactions which are established in the vessel are the following:

$$2Y+3ZnO \rightarrow Y_2O_3+3Zn \quad (2)$$

$$SiO+ZnO \rightarrow SiO_2+Zn \quad (3)$$

The free enthalpy ΔG, relative to one mol of $O_2$, of the main reactants is:

| Temperature | $SiO_2$ | $Y_2O_3$ | ZnO |
|---|---|---|---|
| 500 K: | −781 | −1155 | −603 kJ/mol |
| 1500 K: | −593 | −972 | −335 kJ/mol |

After 1100 hours operating time, the yield of UV C radiation was unchanged at 100% of the original value.

Illustrative Example 13

See FIG. 7

A layer of indium oxide was vapor-deposited in vacuo on the part, opposite the cathode 3, of the vessel wall 1 of a high-current low-pressure Hg lamp. The vapor-deposited metal oxide 13 covered a surface area of 12 $cm^2$ and had a layer thickness of about 5–20μ. The vessel had a tantalum cathode 3 coated with yttrium oxide as the activating substance 4. The main reactions taking place in the operation can be represented as follows:

$$2Y+In_2O_3 \rightarrow Y_2O_3+2In \quad (2)$$

$$3SiO+In_2O_3 \rightarrow 3SiO_2+2In \quad (3)$$

The free enthalpy ΔG, relative to one mol of $O_2$, of the main reactants is as follows:

| Temperature | $SiO_2$ | $Y_2O_3$ | $In_2O_3$ |
|---|---|---|---|
| 500 K: | −781 | −1155 | −545 kJ/mol |
| 1500 K: | −593 | −972 | −314 kJ/mol |

After 1000 hours operating time, no decrease in the radiation intensity was detectable.

Illustrative Example 14

See FIG. 7

In a manner analogous to that indicated under Example 13, tin oxide ($SnO_2$) was vapor-deposited on the part, opposite the cathode 3, of the vessel wall 1. Taking into account a Ni/BaO cathode, the reactions are inter alia the following:

$$2Ba+SnO_2 \rightarrow 2BaO+Sn \quad (2)$$

$$2SiO+SnO_2 \rightarrow 2SiO_2+Sn \quad (3)$$

The free enthalpy ΔG is:

| Temperature | $SiO_2$ | BaO | $SnO_2$ |
|---|---|---|---|
| 500 K: | −781 | −1016 | −483 kJ/mol |
| 1500 K: | −593 | −836 | −272 kJ/mol |

After 400 operating hours, the radiation yield was unchanged.

The heating temperatures and heating times mentioned in the above illustrative examples are average values and can vary within relatively wide limits, depending on the particular application. Moreover, these operating parameters are not relevant to the invention as such. In principle, it is immaterial, in which way the metal oxides are produced and introduced into the vessel.

The process is not restricted to the particular applications described and shown in the illustrative examples and the figures. In particular, it can also be transferred to any other type of metal vapor lamps or to gas discharge vessels filled with a halogen. In the most general case, the process can be applied wherever it is the object to protect internal surfaces of walls, which are built up from metal oxides and form a closed space of physical apparatus or vessel, against reducing influences of metal particles which originate from an activating substance and are present in a solid, liquid or vapor form. The process can be applied without any modification of the operating conditions of the gas discharge vessel which is being modified, i.e., the temperature and pressure conditions are those which are conventionally used.

The invention is not exhausted by the metal oxides (MO) mentioned in the illustrative examples. It is also possible to use the oxides of the elements cadmium, mercury, gallium, thallium, germanium, lead, antimony, bismuth and polonium as the metal oxides which can be reduced in operation. In an advantageous manner, mercury is to be recommended for Hg vapor lamps.

The chemical changes in the vessel wall, which occur during the operation of gas discharge vessels of conventional type and which entail a premature deterioration of their physical properties, in particular of their permeability to radiation, are prevented by the new process in an effective manner. This manifests itself in an improvement of the operability, an increase in the radiation yield and an extension of the life of the vessel. The process is distinguished by universal applicability and is independent of the constructional build-up and the type of the vessel and of the vessel material used.

What is claimed as new and intended to be covered by Letters Patent is:

1. A gas discharge device containing oxide wall portions, which device is used as a radiation source and the oxide wall portions of which are permeable to radiation of a wavelength of from 10 to 1,000 nm and which has an anode and an oxide or sub-oxide activated cathode, and which device further contains located therein a metallic carrier bearing an additional metal oxide extending into the discharge path between the anode and the oxide or sub-oxide activated cathode, on the side of the device immediately adjacent to the cathode, between the cathode and the oxide wall portions, wherein said additional metal oxide has a free enthalpy $\Delta G$, under the pressure and temperature conditions prevailing in the device, which is both greater than the free enthalpy of the oxides from which the oxide wall portions of the device are constructed and is greater than the free enthalpy of the cathode activating oxide or sub-oxide and wherein the metallic carrier is insulated from the other parts of the device and is at a floating potential.

2. The device according to claim 1, wherein the additional metal oxide extending into the discharge path of the vessel is an oxide of at least one of the group consisting of: the elements of Group VB and VIB of the Periodic Table, Mn, Fe, Co, Ni, Cu, Zn, Cd, Hg, Ga, In, Tl, Ge, Sn, Pb, Sb, Bi and Po.

3. The device according to claim 2, wherein the additional metal oxide is vanadium oxide, niobium oxide, tantalum oxide, chromium oxide, molybdenum oxide, tungsten oxide, manganese oxide, iron oxide, cobalt oxide, nickel oxide, indium oxide, tin oxide or a mixture of at least two of the oxides mentioned above.

4. The device according to claim 3 wherein the additional metal oxide is chromium oxide, molybdenum oxide, tungsten oxide, manganese oxide, iron oxide or tin oxide.

5. The device according to claim 4, wherein the additional metal oxide is tungsten trioxide, the oxide or sub-oxide activating substance of the cathode contains barium oxide and the gas discharge device wall consists predominantly of quartz.

6. The gas discharge device according to claim 1, wherein the metallic carrier has the shape of a disc, cylinder, cone, spiral or coil and consists of the same element of the Periodic Table as the metal of the additional metal oxide.

7. The gas discharge device according to claim 6, wherein the metallic carrier has the shape of a coil, surrounds the discharge path like a jacket and consists of tungsten, and the additional metal oxide is tungsten trioxide.

8. A gas discharge device according to claim 1, wherein the cathode is partially surrounded by a cathode envelop insulated from the cathode and the metallic carrier, together with the additional metal oxide, is build into the cathode envelop.

9. A gas discharge device according to claim 1 in which the anode electrode and cathode electrode are distinct electrically separated structures, a discharge path being defined between the anode and cathode.

10. A gas discharge device containing oxide wall portions, which device is used as a radiation source, and the oxide wall portions of which are permeable to radiation of a wavelength of from 10 to 1,000 nm and which has an anode and an oxide or sub-oxide activated cathode, wherein an additional metal oxide has been coated on the inside of the device wall between the anode and the oxide or sub-oxide activated cathode, on the side of the device immediately adjacent to the oxide or sub-oxide activated cathode, wherein said additional metal oxide has a free enthalpy $\Delta G$, under the pressure and temperature conditions prevailing in the device, which is both greater than the free enthalpy of the oxide or oxides from which the oxide wall portions of the device are constructed and is greater than the free enthalpy of the cathode activating oxide or sub-oxide, and wherein said additional metal oxide is an oxide of at least one of the group consisting of the elements of Group VB and VIB of the Periodic Table, Mn, Fe, Co, Ni, Cu, Zu, Cd, Hg, Ga, In, Tl, Ge, Sn, Pb and Po.

11. A gas discharge device according to claim 10, wherein said additional metal oxide has been coated on the inside wall of the by applying a powder or paste to said wall.

12. A gas discharge device according to claim 10, wherein said additional metal oxide has been coated on the inside wall of the device by vapor disposition.

13. A gas discharge device according to claim 10 in which the anode electrode and cathode electrode are distinct electrically separated structures, a discharge path being defined between the anode and cathode.

14. A gas discharge device containing oxide wall portions, which device is used as a radiation source and the oxide wall portions of which are permeable to radiation of a wavelength of from 10 to 1,000 nm and which has an anode and an oxide or sub-oxide activated cathode as distinct electrically separated structures, a discharge path being defined between the anode and cathode, and which device further contains located therein a metallic carrier bearing additional metal oxide extending into the discharge path between the anode and the oxide or sub-oxide activated cathode, on the side of the device immediately adjacent to the cathode, between the cathode and the oxide wall portions, wherein said additional metal oxide has a free enthalpy $\Delta G$, under the pressure and temperature conditions prevailing in the device, which is both greater than the free enthalpy of the oxide or oxides from which the oxide wall portions are constructed and is greater than the free enthalpy of the cathode activating oxide or sub-oxide, the metallic carrier being connected to the cathode so that in operation of the device it is at the cathode potential.

* * * * *